US010914061B1

(12) United States Patent
Mou et al.

(10) Patent No.: US 10,914,061 B1
(45) Date of Patent: Feb. 9, 2021

(54) ASSEMBLED SLAB STEEL-WOOD COMPOSITE JOINT AND ASSEMBLY METHOD THEREOF

(71) Applicant: QINGDAO UNIVERSITY OF TECHNOLOGY, Qingdao (CN)

(72) Inventors: Ben Mou, Qingdao (CN); Peng Feng, Qingdao (CN); Yi Liu, Qingdao (CN); Zunqiang Li, Qingdao (CN); Jiuwen Bao, Qingdao (CN)

(73) Assignee: QINGDAO UNIVERSITY OF TECHNOLOGY, Qingdao (CN)

( * ) Notice: Subject to any disclaimer, the term of this patent is extended or adjusted under 35 U.S.C. 154(b) by 0 days.

(21) Appl. No.: 16/940,410

(22) Filed: Jul. 28, 2020

(30) Foreign Application Priority Data

Sep. 4, 2019 (CN) ..... 2019 1 0833533

(51) Int. Cl.

| | |
|---|---|
| ***E04B 1/26*** | (2006.01) |
| ***E04B 1/30*** | (2006.01) |
| ***E04B 5/12*** | (2006.01) |
| ***E04C 3/36*** | (2006.01) |
| ***E04B 5/02*** | (2006.01) |

(52) U.S. Cl.
CPC ..... *E04B 1/2608* (2013.01); *E04B 1/30* (2013.01); *E04B 5/023* (2013.01); *E04B 5/12* (2013.01); *E04C 3/36* (2013.01); *E04B 2001/2644* (2013.01); *E04B 2001/2652* (2013.01); *E04B 2103/04* (2013.01)

(58) Field of Classification Search
CPC ..... E04B 1/2608; E04B 5/023; E04B 1/30; E04B 5/12; E04B 2001/2644; E04B 2103/04; E04B 2001/2652; E04C 3/36
See application file for complete search history.

(56) References Cited

U.S. PATENT DOCUMENTS 3,938,294 A * 2/1976 Gaburri ..... E04B 1/30 52/742.14
8,359,797 B2 * 1/2013 Lee ..... E04B 1/04 52/259
8,549,805 B2 * 10/2013 Kim ..... E04C 5/0645 52/260

(Continued)

FOREIGN PATENT DOCUMENTS

CN 104727439 A 6/2015

*Primary Examiner* — Rodney Mintz
(74) *Attorney, Agent, or Firm* — Bayramoglu Law Offices LLC

(57) ABSTRACT

An assembled slab-type steel-wood composite joint, includes a steel-wood composite column, square wood beams, connecting assemblies for connecting the steel-wood composite column and the square wood beams, and wood slabs connected to and supported by the steel-wood composite column, the square wood beams and the connecting assemblies. The steel-wood composite column includes a hollow cross-shaped outer square wood column, and square blocks are integrally formed on the outer square wood column; and a steel sleeve is inlaid in the outer square wood column, an inner wood column is inlaid in the steel sleeve, column vertical steel bars penetrate through the inner wood column, horizontal steel bars penetrate through the square blocks and are fixedly connected to the steel sleeve, and threads are arranged at the ends of the horizontal steel bars.

5 Claims, 6 Drawing Sheets

(56) References Cited

U.S. PATENT DOCUMENTS

| | | | | |
|---|---|---|---|---|
| 8,621,803 | B2 * | 1/2014 | Efros | E04G 23/0237 52/391 |
| 10,024,047 | B2 * | 7/2018 | Zavitz | E04B 1/215 |
| 10,094,101 | B1 * | 10/2018 | Jazzar | E04B 5/32 |
| 10,167,623 | B2 * | 1/2019 | Mou | E04B 1/2403 |
| 10,260,224 | B1 * | 4/2019 | Jazzar | E04G 11/48 |
| 10,378,197 | B2 * | 8/2019 | Kurosawa | E04B 5/29 |
| 10,557,264 | B2 * | 2/2020 | Zavitz | E04B 5/17 |
| 10,619,342 | B2 * | 4/2020 | Zavitz | E04B 1/21 |
| 10,633,851 | B2 * | 4/2020 | Mou | E04B 1/2403 |
| 10,822,789 | B1 * | 11/2020 | Mou | E04B 1/2608 |
| 2011/0131908 | A1 * | 6/2011 | Lee | E04B 5/023 52/283 |
| 2013/0111839 | A1 * | 5/2013 | Efros | E04G 23/0237 52/391 |
| 2014/0245693 | A1 * | 9/2014 | Efros | E04B 1/26 52/741.4 |
| 2015/0191907 | A1 * | 7/2015 | Efros | E04B 5/12 52/745.05 |
| 2016/0230386 | A1 * | 8/2016 | Zavitz | E04B 5/17 |
| 2017/0051495 | A1 * | 2/2017 | Zavitz | E04B 1/215 |
| 2017/0175376 | A1 * | 6/2017 | Calderon Uriszar-Aldaca | E04B 1/215 |
| 2018/0127966 | A1 * | 5/2018 | Kurosawa | E04B 1/30 |
| 2018/0187407 | A1 * | 7/2018 | Mou | E04B 1/2403 |
| 2018/0291612 | A1 * | 10/2018 | Zavitz | E04C 5/0645 |
| 2019/0010695 | A1 * | 1/2019 | Zavitz | E04C 5/0645 |
| 2019/0376273 | A1 * | 12/2019 | Mou | E04B 1/2403 |
| 2020/0149288 | A1 * | 5/2020 | Griechen | E04B 1/08 |
| 2020/0190799 | A1 * | 6/2020 | Wong | E04B 5/38 |

* cited by examiner

ASSEMBLED SLAB STEEL-WOOD COMPOSITE JOINT AND ASSEMBLY METHOD THEREOF

CROSS REFERENCES TO THE RELATED APPLICATIONS

This application is based upon and claims priority to Chinese Patent Application No. 201910833533.0, filed on Sep. 4, 2019, the entire contents of which are incorporated herein by reference.

TECHNICAL FIELD

The present invention relates to a novel assembled slab steel-wood composite joint, and belongs to the field of building construction.

BACKGROUND

With the gradual transformation of the development mode of the construction industry, quality and efficiency improvement, energy conservation and emission reduction have become inevitable construction requirements of production in the construction industry. Compared with traditional buildings, prefabricated buildings can minimize engineering problems caused by poor engineering quality, thus effectively guaranteeing the engineering quality and construction safety.

Previous Chinese Invention Patent Application No. CN201510106368.0 discloses a novel prefabricated concrete column-beam structure and an assembly and connection method thereof. The novel prefabricated concrete column-beam structure comprises prefabricated concrete edge columns abbreviated as prefabricated edge columns hereinafter, prefabricated concrete central columns abbreviated as prefabricated central columns hereinafter, and prefabricated concrete beam structures abbreviated as prefabricated beams hereinafter, wherein, column top grouting grooves are formed in the tops of the prefabricated edge columns and have column vertical steel bars assembled therein, and the lower ends of the column vertical steel bars stretch into column sleeves; column bottom grouting grooves are formed in the bottoms of the prefabricated edge columns, edge column bar slots are formed in the outer sides of the bottoms of the prefabricated edge columns, across-beam steel bar holes penetrating through the edge columns are formed in the tops of edge column bar slots, and edge column reserved steel bars and steel bars connected to beam bottom steel bars are arranged at the tops of the prefabricated edge columns; column top grouting grooves are formed in the tops of the prefabricated middle columns, column bottom grouting grooves and across-beam steel bar holes are formed in the bottoms of the prefabricated middle columns, and middle column reserved steel bars and steel bars connected to the beam bottom steel bars are arranged at the tops of the prefabricated middle columns; outer column stirrups and inner column stirrups are arranged in the prefabricated edge columns and the prefabricated middle columns in the height direction of the edge columns; and steel poles having embedded ends tapped with threads and beam stirrups are regularly arranged in the length direction of the prefabricated beams, and the beam bottom steel bars are arranged at the bottoms of the prefabricated beams.

Compared with existing common assembled slab design techniques, the above solution mainly adopts the prefabricated concrete structure and steel bar connecting structure and has the disadvantages that materials are difficult to obtain, modular connection and construction cannot be realized, and the construction speed is low; and more importantly, welding has to be conducted to improve the strength of steel connection joints, and the construction quality cannot be guaranteed. Moreover, the weight of the whole joints is large, and the bearing capacity of the joints is relatively low.

To sum up, the building joint techniques in the prior art cannot be widely popularized in the industry and are low in degree of standardization. In view of this, this patent application is put forward.

SUMMARY

To solve the problems of the prior art, the present invention provides an assembled slab steel-wood composite joint and an assembly method thereof. The assembled composite joint of a steel-wood composite structure is adopted to realize a novel assembled slab structure, so that the design purposes of improving the joint strength, reducing quality problems caused by welding, improving the overall bearing capacity and lowering the probability of joint destruction are fulfilled by means of steel-based mechanical connection.

To fulfill the aforesaid design purposes, the assembled slab steel-wood composite joint comprises a steel-wood composite column, square wood beams, connecting assemblies for connecting the steel-wood composite column and the square wood beams, and wood slabs connected to and supported by the steel-wood composite column, the square wood beams and the connecting assemblies, wherein:

The steel-wood composite column comprises a hollow outer square wood column, integrally-formed square blocks are arranged on vertical outer sides of the outer square wood column, and the outer square wood column has a cross-shaped sectional structure; a steel sleeve is inlaid in the outer square wood column, an inner wood column is inlaid in the steel sleeve, column vertical steel bars penetrate through the inner wood column, inner ends of horizontal steel bars penetrate through the square blocks to be fixedly connected to the steel sleeve, and threads are arranged at outer ends of the horizontal steel bars;

The square wood beams have vertical protruding steel bars stretching therein, and threads are arranged at outer ends of the vertical protruding steel bars; and a plurality of fifth bolt holes to be connected to the wood slabs are formed in the tops of the square wood beams;

S-shaped insertion heads used for inserted connection of the adjacent wood slabs are formed on lateral portions of the wood slabs, and fifth bolt holes to be connected to the square wood beams and slab threaded holes to be connected to the adjacent wood slabs are formed in joints; and Each connecting assembly comprises a threaded sleeve having two ends respectively connected to the horizontal steel bars and the vertical protruding steel bars.

On the basis of the above basic design concept, the assembled composite joint of the steel-wood composite structure combines two materials to realize complementation of the materials, so that the strength of the wood structure is remarkably improved; and by adding the wood structure in the steel structure, the structural weight can be reduced, the structural strength per unit mass can be improved, and the durability is extremely high. The modular structure allows materials to be obtained easily, and the construction speed is high. The beams and the column are mechanically connected by means of steel, so that the strength of the joint is improved, and quality problems caused by welding are reduced; by adding the steel structure in the wood column structure, the overall bearing capacity of the wood structure is remarkably improved; and the entire composite joint has high strength, the probability of joint destruction can be lowered to a certain extent, and the joint is restorable Compared with solid wood columns, the strength of the steel sleeve of the steel-wood composite column is greatly improved, the horizontal steel bars arranged in the cross-shaped outer wood column can greatly improve the stress performance and seismic performance, and the bearing capacity per unit mass of the steel-wood composite column is higher than that of pure wood structures. The square blocks of the cross-shaped steel-wood composite column provide a work plane for beam-column connection. The column vertical steel bars in the inner wood column of improve the pressure-bearing performance and tensile strength of the wood column and ensure that the seismic performance per unit mass of the wood column is superior.

The wood slabs are provided with the S-shaped insertion heads for assembly, so that the assembly performance is good, and the wood slabs improve the noise absorption and insulation effect in a building; and the assembled connection structure improves the overall construction efficiency and reaches the level of standardization and productization of building construction The cross-shaped steel-wood composite column and the square wood beams are mechanically connected by the connecting assemblies adopting the threaded steel bar sleeves, connection is easy and convenient, and welding is not needed, so that the construction quality and efficiency are greatly improved.

To further improve the bearing capacity of the assembled slab structure and increase the utilization rate of wood, the following preferred and improved solution may be adopted: each wood slab comprises an L-shaped slab and a square slab, the L-shaped slabs are disposed at the tops of the square blocks and the connecting parts and are connected in an inserted manner around the steel-wood composite column, and the square slabs are connected in an inserted manner around the L-shaped slabs.

The fixation manner of the assembled slabs can effectively improve the construction efficiency of the slabs, further improve the fixed connection of the slabs, the beams and the column, and realize cyclically developing buildings.

More preferably, each connecting assembly further comprises a connecting part, which includes a C-shaped left hollowed-out cover plate and a C-shaped right hollowed-out cover plate, wherein the bottoms of the left hollowed-out cover plate and the right hollowed-out cover plate are horizontally connected and are assembled and fixed together through bolt backing plates and bottom bolts; second bolt holes and fourth bolt holes used for fixed connection are respectively and correspondingly formed in portions, to be connected to the connecting parts, of horizontal surfaces and vertical surfaces of the square blocks of the outer square wood column; first bolt holes and third bolt holes used for fixed connection are respectively and correspondingly formed in portions, to be connected to the connecting parts, of horizontal surfaces and vertical surfaces of the square wood beams; and sixth bolt holes used for fixed connection are respectively and correspondingly formed in portions, to be connected to the connecting parts, of the insertion heads of the wood slabs.

The connecting parts of the connecting assemblies fulfill secondary fixation and connection of the beams and the column, the C-shaped hollow-out cover plates of the connecting parts can be horizontally and vertically fastened and connected to the square wood beams and the square blocks of the steel-wood composite columns through corresponding bolt holes, so that transitional connection of the slabs with the beams and the column is reliably implemented. An existing steel bar welding process can be replaced on the basis of mechanical connection of the threaded sleeves, the steel bars in the beams and the steel bars in the column, so that quality problems caused by welding can be avoided.

On the basis of the structural design of the assembled slab steel-wood composite joint, the present application further provides a corresponding assembly method, which comprises:

Step 1): disposing the steel sleeve in the outer square wood column, fixedly connecting the inner ends of the horizontal steel bars to the steel sleeve, filling the inner wood column in the steel sleeve, and inserting the vertical steel bars in the inner wood column;

Step 2): inserting the vertical protruding steel bars in the square wood beams, and enabling the steel bars to protrude out of the square wood beams;

Step 3): after the steel-wood composite column and the square wood beams are assembled, connecting protruding parts of the steel bars through the threaded sleeves;

Step 4): assembling the left hollowed-out cover plates and the right hollowed-out cover plates through the bolt backing plates to form the connecting parts, and horizontally connecting and fastening the connecting parts with the steel-wood composite column and the steel wood beams through bolt holes and bolts at both ends;

Step 5): disposing the L-shaped slabs at the tops of the square blocks and the connecting parts, connecting the L-shaped slabs around the steel-wood composite column, and horizontally and fixedly connecting the L-shaped slabs with the square wood beams and the connecting parts through of bolts; and Step 6): connecting the square slabs in an inserted manner around the L-shaped slabs, and horizontally and fixedly connecting the square slabs with the L-shaped slabs and the square wood beams through of bolts.

As described above, the assembled slab steel-wood composite joint and the assembly method thereof provided by the present application have the following advantages:

1. The novel assembled slab steel-wood composite joint structure provided by the present application increases the utilization rate of different building materials and enriches modem building systems.

2. The design of the assembled joint realizes construction productization, shortens the construction period, avoids engineering problems caused by poor construction quality resulting from welding, and reduces the construction cost.

3. The assembled beams can be prefabricated in advance, so that the construction process is simplified, the construction efficiency is improved, and the construction cost can be reduced.

4. The beam and the columns are connected by the mechanical connecting assemblies of a steel structure, so that quality problems caused by welding of steel structures are effectively avoided; and the connecting assemblies of the steel structure are high in strength, thus improving the stress performance of the joint.

5. The design of the steel-wood composite structure improves the overall bearing capacity of the structure, realizes the restorability after destruction, and satisfies the recycling requirements of building development

BRIEF DESCRIPTION OF THE DRAWINGS

The present application is further explained below in conjunction with the following accompanying drawings.

In the figures: 1, steel-wood composite column; 2, square wood beam; 3, wood slab; 4, connecting assembly; 5, outer square wood column; 6, vertical steel bar; 7, steel sleeve; 8, inner wood column; 9, threaded sleeve; 10, connecting part; 11, first bolt hole; 12, second bolt hole; 13, third bolt hole; 14, fourth bolt hole; 15, fifth bolt hole; 16, sixth bolt hole; 17, bolt backing plate; 18, left hollowed-out cover plate; 19, right hollowed-out cover plate; 20, S-shaped insertion head; 21, L-shaped slab; 22, square slab; 23, slab threaded hole; 123, horizontal steel bar; 456, vertical protruding steel bar.

DETAILED DESCRIPTION OF THE EMBODIMENTS

Embodiment 1: An embodiment of the present application is detailed below in conjunction with the accompanying drawings.

Figure 1:
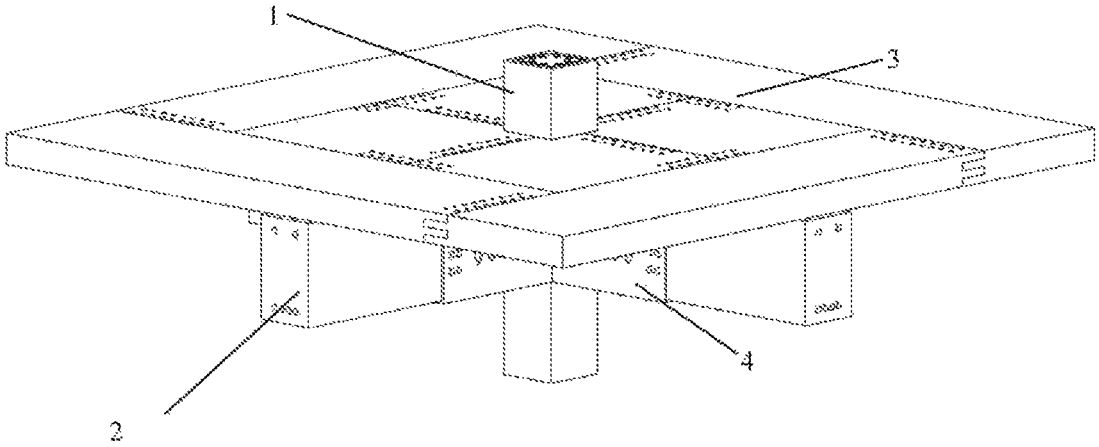
FIG. 1 is a structural diagram of an assembled slab steel-wood composite joint of the present application.
Figure 2:
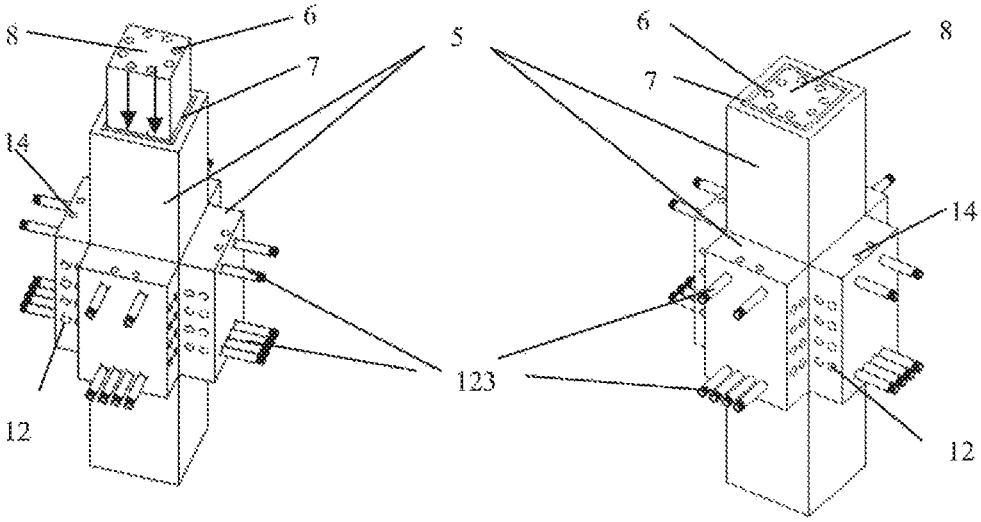
FIG. 2 is a schematic diagram of the assembly process of a steel-column composite column.
Figure 3:
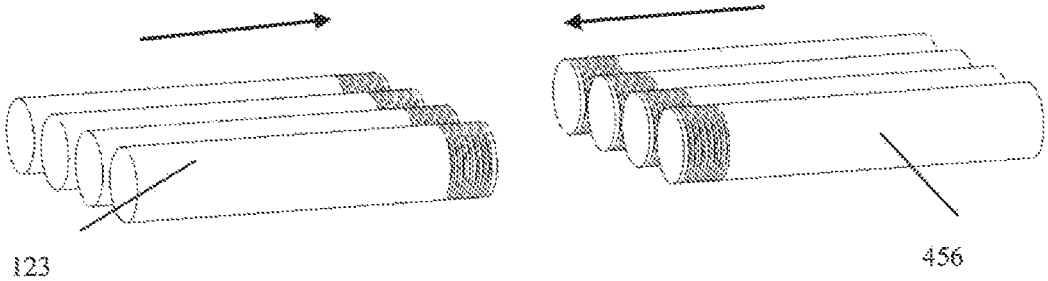
FIG. 3 is a schematic diagram of the structure and assembly process of threaded sleeves, horizontal steel bars and vertical protruding steel bars.
Figure 3:
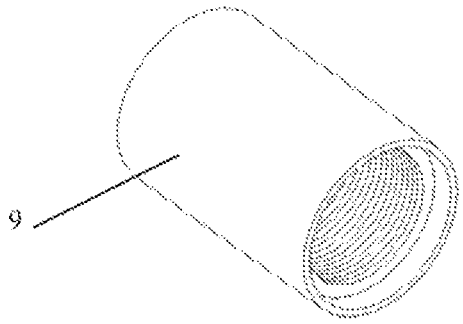
Figure 3:
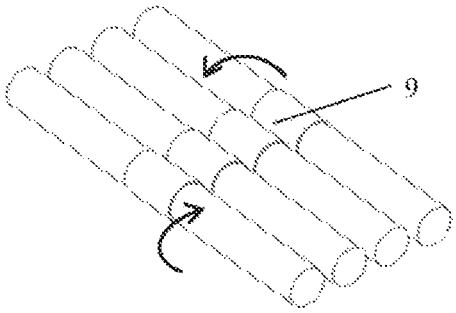
Figure 4:
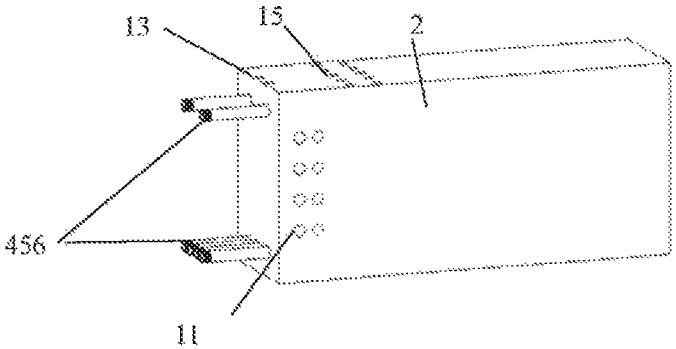
FIG. 4 is a structural diagram of a square wood beam.
Figure 5:
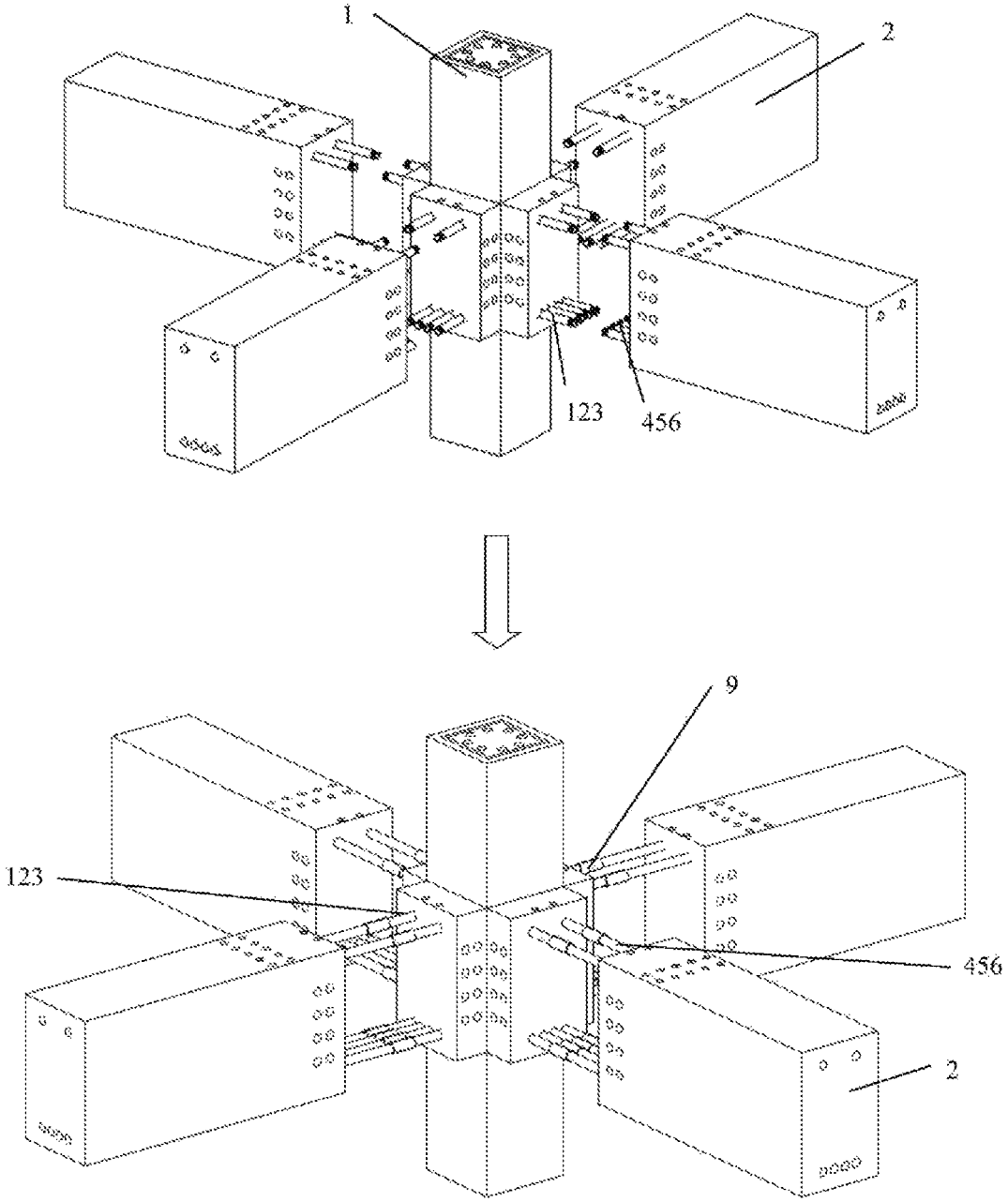
FIG. 5 is a schematic diagram of column-beam connection by means of the threaded sleeves.
Figure 6:
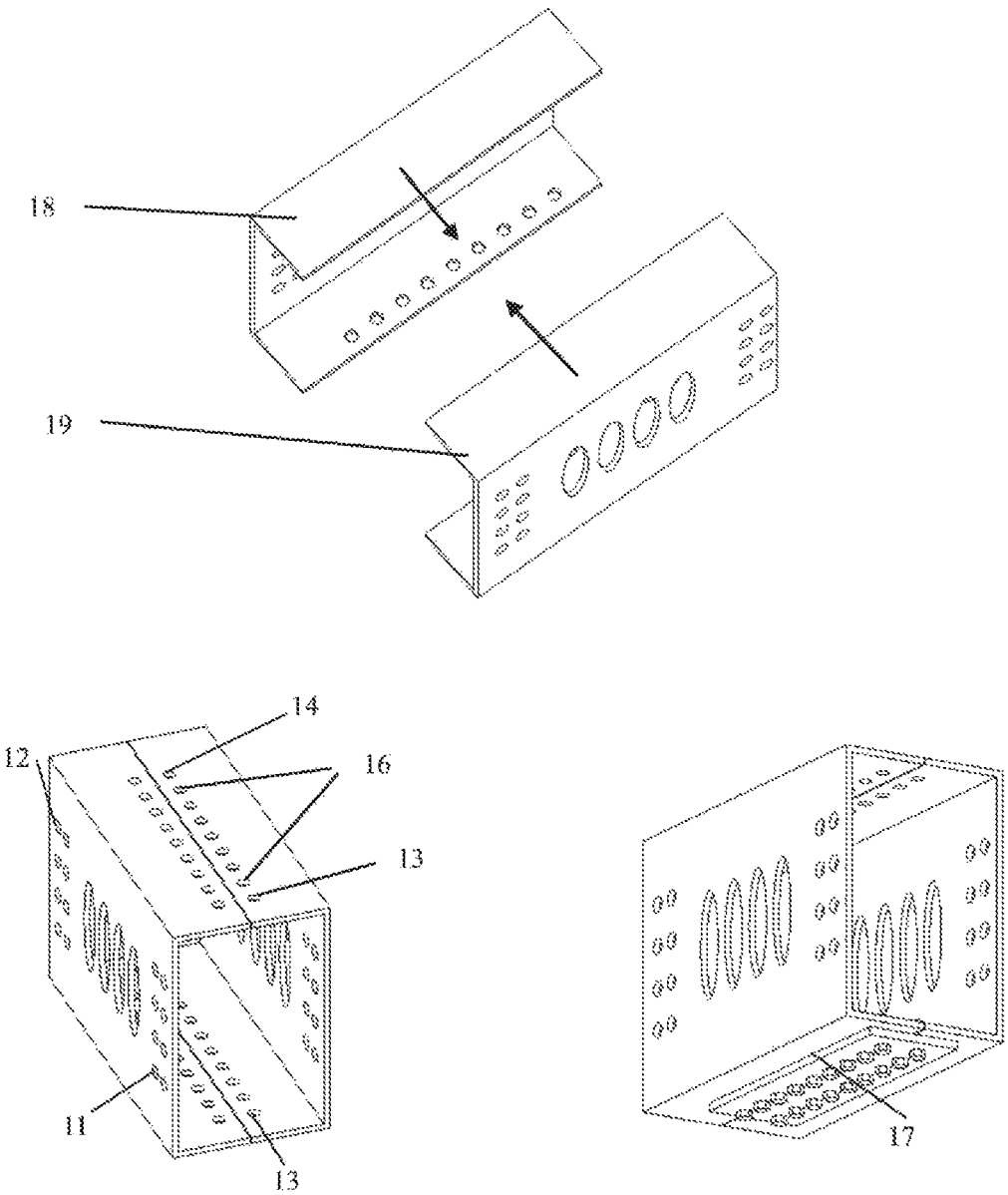
FIG. 6 is a structure and connection diagram of a connecting part of a connecting assembly.
Figure 7:
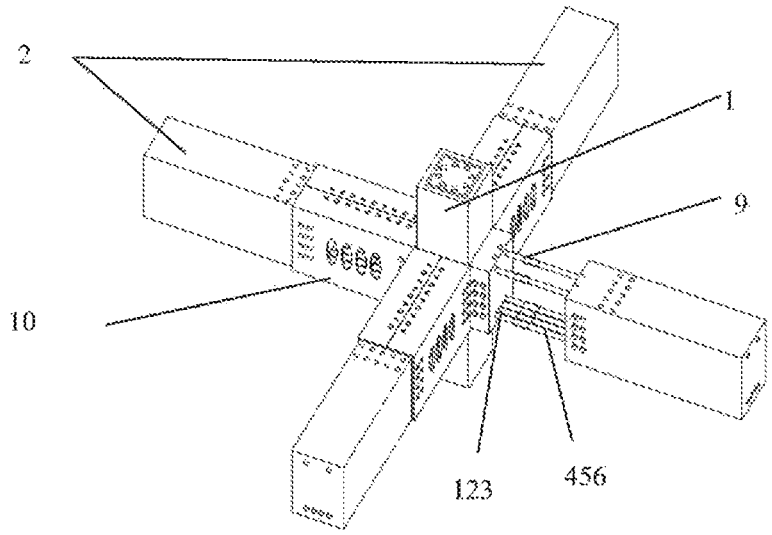
FIG. 7 is beam-column connection diagram after the connecting parts are added.
Figure 8:
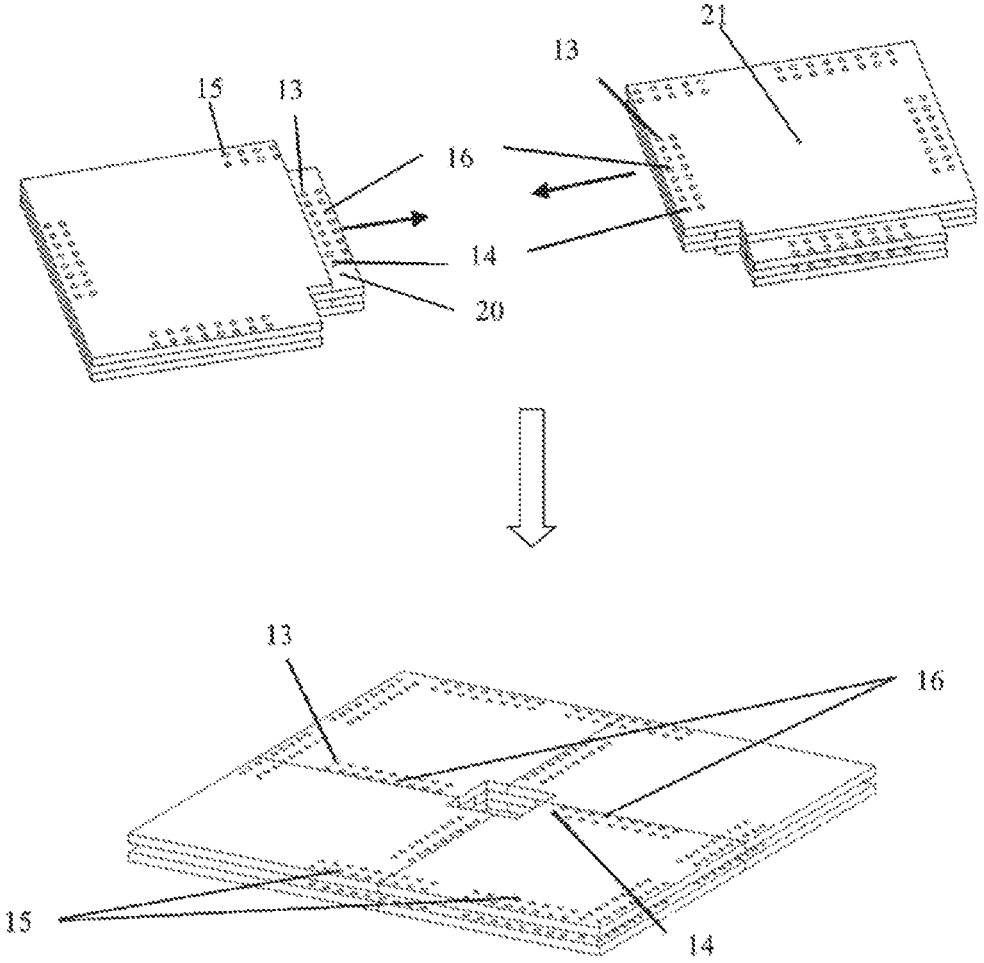
FIG. 8 is a structural and assembly diagram of L-shaped slabs.
Figure 9:
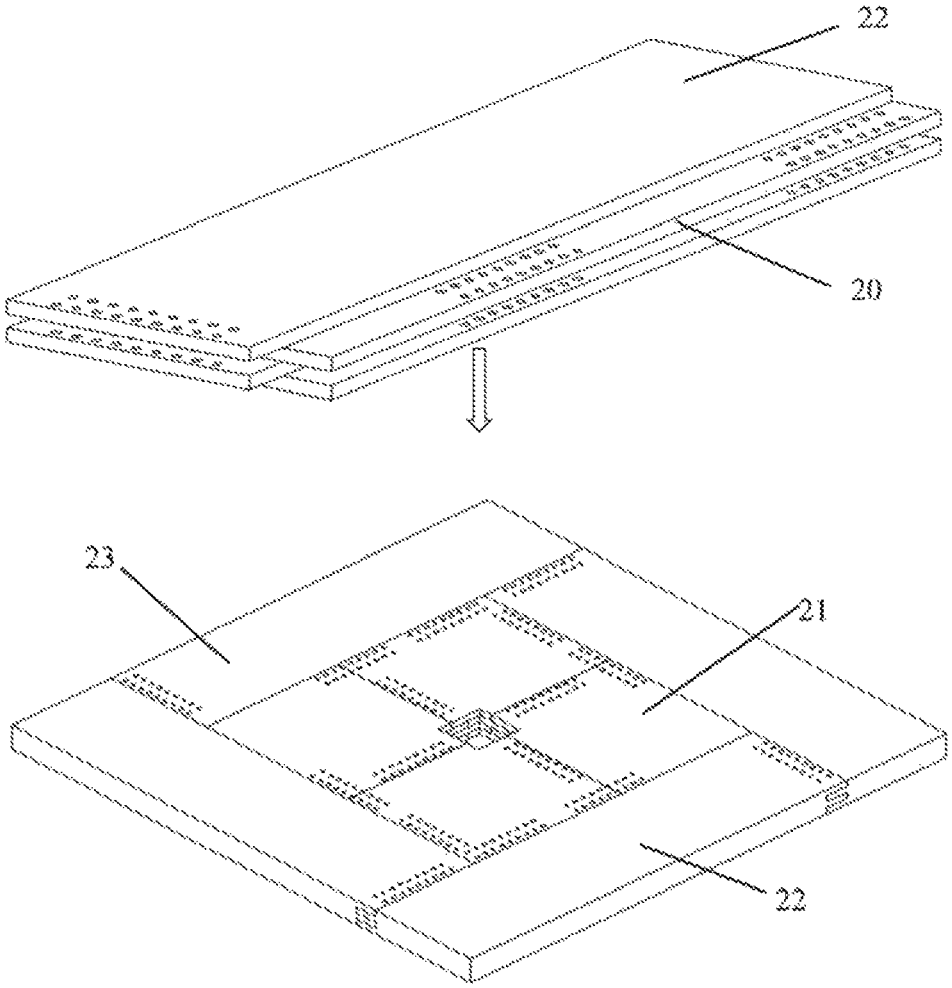
FIG. 9 is a structure and assembly diagram of square slabs and L-shaped slabs.

As shown in FIG. 1 to FIG. 9, an assembled slab steel-wood composite joint mainly comprises a steel-wood composite column 1, square wood beams 2, wood slabs 3 and connecting assemblies 4, wherein:

The steel-wood composite column 1 comprises a hollow outer square wood column 5, wherein integrally-formed square blocks arranged on the vertical outer sides of the outer square wood column 5, and the outer square wood column 5 has a cross-shaped sectional structure; a steel sleeve 7 is inlaid in the outer square wood column 5 and is preferably of a straight sleeve structure, and an inner wood column 8 is inlaid in the steel sleeve 7: the inner column 8 is preferably a square wood column, a plurality of column vertical steel bars 6 penetrate through the inner wood column 8, inner ends of horizontal steel bars 123 penetrate through the square blocks and are fixed on the steel sleeve 7, and straight threads are arranged at outer ends of the horizontal steel bars 123; and second bolt holes 12 and fourth bolt holes 14 used for fixed connection are respectively formed in portions, to be connected to connecting parts 10, of horizontal surfaces and vertical surfaces of the square blocks of the outer square wood column 5.

The square wood beams 2 have a plurality of vertical protruding steel bars 456 stretching therein, and straight threads are arranged at outer ends of the vertical protruding steel bars 456; a plurality of fifth bolt holes 15 to be connected to the wood slabs 3 are formed in the tops of the square wood beams 2; and first bolt holes 11 and third bolt holes 13 used for fixed connection are respectively and correspondingly formed in portions, to be connected to the connecting parts 10, of horizontal surfaces and vertical surfaces of the square wood beams 2.

Each wood slab 3 comprises an L-shaped slab 21 and a square slab 22. The L-shaped slabs 21 are disposed at the tops of the square blocks and the connecting parts 10 and are connected in an inserted manner around the steel-wood composite column 1, and the square slabs 22 are connected in an inserted manner around the L-shaped slabs 21. S-shaped insertion heads 20 for adjacent insertion are arranged on lateral portions of the L-shaped slabs 21 and the square slabs 22; fifth bolt holes 15 to be connected to the square wood beams 2 and slab threaded holes 23 to be connected to the adjacent wood slabs 3 are formed in the joints; and sixth bolt holes 16 used for fixed connection are correspondingly formed in portions, to be connected to the connecting parts 10, of the insertion heads 20 of the wood slabs 3.

Each connecting assembly 4 comprises a threaded sleeve 9 having two ends respectively connected to the horizontal steel bars 123 and the vertical protruding steel bars 456, and one connecting part 10, wherein the threaded sleeve 9 is preferably of a straight sleeve structure, the connecting part 10 comprises a C-shaped left hollowed-out cover plate 18 and a C-shaped right hollowed-out cover plate 19, and the bottoms of the left hollowed-out cover plate 18 and the right hollowed-out cover plate 19 are horizontally connected and are assembled and fixed together by means of bolt backing plates 17 and bottom bolts; second bolt holes 12 and fourth bolt holes 14 used for fixed connection are respectively and correspondingly formed in portions, to be connected to the corresponding square block of the outer square wood column 5, of the horizontal surface and the vertical surface of the connecting part 10 first bolt holes 11 and third bolt holes 13 used for fixed connection are respectively and correspondingly formed in portions, to be connected to the corresponding square wood beam 2, of the horizontal surface and the vertical surface of the connecting part 10; and sixth bolt holes 16 used for fixed connection are correspondingly formed in portions, to be connected to the insertion heads 20 of the corresponding wood slab 3, of the connecting part 10.

On the basis of the structural design of the assembled slab steel-wood composite joint, an assembly method of the composite joint is implemented through the following steps:

Step 1): the steel sleeve 7 is disposed in the outer square wood column 5, the horizontal steel bars 123 are anchored, the inner wood column 8 is filled in the steel sleeve 7, and the vertical steel bars 6 are inserted into the inner wood column 8;

Step 2): the vertical protruding steel bars 456 are inserted into the square wood beams 2 and protrude out of the square wood beams 2;

Step 3): after the steel-wood composite column 1 and the square wood beams 2 are assembled, protruding parts of the steel bars are connected by means of the threaded sleeves 9;

Step 4): the left hollowed-out cover plates 18 and the right hollowed-out cover plates 19 are assembled by means of the bolt backing plates 17 to form the connecting parts 10, and the connecting parts 10 are horizontally connected and fastened with the steel-wood composite column 1 and the square wood beams 2 by means of bolt holes and bolts at both ends;

Step 5): the L-shaped slabs 21 are disposed at the tops of the square blocks and the connecting parts 10 and are connected around the steel-wood composite column, and the L-shaped slabs 21 are horizontally and fixedly connected to the square wood beams 2 and the connecting parts 10 through bolts; and Step 6): the square slabs 22 are connected in an inserted manner around the L-shaped slabs 21, and are horizontally and fixedly connected to the L-shaped slabs 21 and the square wood beams 2 through bolts.

Compared with steel structures in the prior art, the steel-wood composite structure formed by steel and wood in this embodiment has better stress performance per unit mass and has good seismic performance under the effect of an earthquake due to the fact that wood has certain tenacity. Compared with wood structures in the prior art, the column in this embodiment is of a steel-wood structure, the steel sleeve and the vertical steel bars are additionally arranged in the cross-shaped column, so that the stress performance per unit mass of the structure is improved, and the overall life is prolonged; steel bars are arranged in the square wood beams to improve the tensile strength of the wood beams, so that the shear resistance of the wood beams is better than that of I-beams; and the whole joint is assembled by means of mechanical connection, so that the components can be changed more easily under the effect of an earthquake. Components can be customized in advance, prefabricated construction on the construction field is realized, quality problems caused by welding of steel components are avoided, the construction period is shortened, and the construction cost is reduced.

Similar technical solutions can be derived in combination with the accompanying drawings and the solution described above. All solutions obtained without departing from the structure of the present invention should also fall within the protection scope of the present application.

What is claimed is:

1. An assembled slab steel-wood composite joint, comprising:

a steel-wood composite column, a plurality of square wood beams, a plurality of connecting assemblies configured for connecting the steel-wood composite column and the plurality of square wood beams, and a plurality of wood slabs connected to and supported by the steel-wood composite column, the plurality of square wood beams and the plurality of connecting assemblies, wherein:

the steel-wood composite column comprises a hollow outer square wood column, a plurality of integrally-formed square blocks are arranged on a plurality of vertical outer sides of the hollow outer square wood column, and the hollow outer square wood column has a cross-shaped sectional structure; a steel sleeve is inlaid in the hollow outer square wood column, an inner wood column is inlaid in the steel sleeve, a plurality of column vertical steel bars penetrate through the inner wood column, a plurality of inner ends of a plurality of horizontal steel bars penetrate through the plurality of integrally-formed square blocks configured to be fixedly connected to the steel sleeve, and a plurality of threads are arranged at a plurality of outer ends of the plurality of horizontal steel bars;

the plurality of square wood beams have a plurality of vertical protruding steel bars stretching in the plurality of square wood beams, and the plurality of threads are arranged at a plurality of outer ends of the plurality of vertical protruding steel bars; and a plurality of bolt holes are configured to be connected to the plurality of wood slabs and are formed in a plurality of tops of the plurality of square wood beams;

a plurality of S-shaped insertion heads configured for inserted connection of a plurality of adjacent wood slabs are formed on a plurality of lateral portions of the plurality of wood slabs, and the plurality of bolt holes are configured to be connected to the plurality of square wood beams and a plurality of slab threaded holes are configured to be connected to the plurality of adjacent wood slabs and are formed in a plurality of joints; and each connecting assembly of the plurality of connecting assemblies comprises a threaded sleeve of a plurality of threaded sleeves; two ends of the threaded sleeve of the plurality of threaded sleeves are respectively connected to the plurality of horizontal steel bars and the plurality of vertical protruding steel bars.

2. The assembled slab steel-wood composite joint according to claim 1, wherein each wood slab of the plurality of wood slabs comprises an L-shaped slab of a plurality of L-shaped slabs and a square slab of a plurality of square slabs, the plurality of L-shaped slabs are disposed at a plurality of tops of the plurality of integrally-formed square blocks and are connected in an inserted manner around the steel-wood composite column, and the plurality of square slabs are connected in an inserted manner around the plurality of L-shaped slabs.

3. The assembled slab steel-wood composite joint according to claim 2, wherein the each connecting assembly of the plurality of connecting assemblies further comprises a connecting part, wherein the connecting part comprising a C-shaped left hollowed-out cover plate and a C-shaped right hollowed-out cover plate;

the plurality of bolt holes are a plurality of fifth bolt holes;

a plurality of bottoms of the C-shaped left hollowed-out cover plate and the C-shaped right hollowed-out cover plate are horizontally connected and are assembled and fixed together by a plurality of bolt backing plates and a plurality of bottom bolts;

a plurality of second bolt holes and a plurality of fourth bolt holes used for fixed connection are respectively and correspondingly formed in horizontal surfaces and vertical surfaces of first portions, and the plurality of integrally-formed square blocks of the hollow outer square wood column and a plurality of connecting parts are connected at the first portions;

and a plurality of first bolt holes and a plurality of third bolt holes used for fixed connection are respectively and correspondingly formed in horizontal surfaces and vertical surfaces of second portions, the plurality of square wood beams and the plurality of connecting parts are connected at the second portions; and a plurality of sixth bolt holes used for fixed connection are respectively and correspondingly formed in horizontal surfaces and vertical surfaces of third portions, the plurality of S-shaped insertion heads the plurality of wood slabs and the plurality of connecting parts are connected at the third portions.

4. An assembly method of the assembled slab steel-wood composite joint according to claim 1, comprising the following steps:

step 1): disposing the steel sleeve in the hollow outer square wood column, fixedly connecting the plurality of inner ends of the plurality of horizontal steel bars to the steel sleeve, filling the inner wood column in the steel sleeve, and inserting the plurality of column vertical steel bars in the inner wood column;

step 2): inserting the plurality of vertical protruding steel bars in the plurality of square wood beams, and enabling a plurality of steel bars to protrude out of the plurality of square wood beams;

step 3): after the steel-wood composite column and the plurality of square wood beams are assembled, connecting a plurality of protruding parts of the plurality of steel bars through the plurality of threaded sleeves;

step 4): assembling a C-shaped left hollowed-out cover plate and a C-shaped right hollowed-out cover plate through a plurality of bolt backing plates to form a plurality of connecting parts, and horizontally connecting and fastening the plurality of connecting parts to the steel-wood composite column and the plurality of square wood beams through the plurality of bolt holes and a plurality of bolts at both ends;

step 5): disposing a plurality of L-shaped slabs at the plurality of tops of the plurality of integrally-formed square blocks and the plurality of connecting parts, connecting the plurality of L-shaped slabs around the steel-wood composite column, and horizontally and fixedly connecting the plurality of L-shaped slabs to the plurality of square wood beams and the plurality of connecting parts through the plurality of bolts; and step 6): connecting the plurality of square slabs in an inserted manner around the plurality of L-shaped slabs, and horizontally and fixedly connecting the plurality of square slabs to the plurality of L-shaped slabs and the plurality of square wood beams through the plurality of bolts.

5. An assembly method of the assembled slab steel-wood composite joint according to claim 2, comprising the following steps:

step 1): disposing the steel sleeve in the hollow outer square wood column, fixedly connecting the plurality of inner ends of the plurality of horizontal steel bars to the steel sleeve, filling the inner wood column in the steel sleeve, and inserting the plurality of column vertical steel bars in the inner wood column;

step 2): inserting the plurality of vertical protruding steel bars in the plurality of square wood beams, and enabling a plurality of steel bars to protrude out of the plurality of square wood beams;

step 3): after the steel-wood composite column and the plurality of square wood beams are assembled, connecting a plurality of protruding parts of the plurality of steel bars through the plurality of threaded sleeves;

step 4): assembling a C-shaped left hollowed-out cover plate and a C-shaped right hollowed-out cover plate through the plurality of bolt backing plates to form the plurality of connecting parts, and horizontally connecting and fastening the plurality of connecting parts to the steel-wood composite column and the plurality of square wood beams through the plurality of bolt holes and a plurality of bolts at both ends;

step 5): disposing the plurality of L-shaped slabs at the plurality of tops of the plurality of integrally-formed square blocks and the plurality of connecting parts, connecting the plurality of L-shaped slabs around the steel-wood composite column, and horizontally and fixedly connecting the plurality of L-shaped slabs to the plurality of square wood beams and the plurality of connecting parts through the plurality of bolts; and step 6): connecting the plurality of square slabs in an inserted manner around the plurality of L-shaped slabs, and horizontally and fixedly connecting the plurality of square slabs to the plurality of L-shaped slabs and the plurality of square wood beams through the plurality of bolts.

* * * * *